US009726421B2

(12) United States Patent
Kempfle

(10) Patent No.: US 9,726,421 B2
(45) Date of Patent: Aug. 8, 2017

(54) HOUSEHOLD APPLIANCE COMPRISING A DOOR OPENING AID

(71) Applicant: BSH HAUSGERÄTE GMBH, München (DE)

(72) Inventor: Stephan Kempfle, Ellzee (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/122,212

(22) PCT Filed: Feb. 5, 2015

(86) PCT No.: PCT/EP2015/052377

§ 371 (c)(1),
(2) Date: Aug. 29, 2016

(87) PCT Pub. No.: WO2015/128165

PCT Pub. Date: Sep. 3, 2015

(65) Prior Publication Data

US 2016/0363364 A1 Dec. 15, 2016

(30) Foreign Application Priority Data

Feb. 28, 2014 (DE) ..... 10 2014 203 683

(51) Int. Cl.

| | |
|---|---|
| ***A47B 96/04*** | (2006.01) |
| ***F25D 23/02*** | (2006.01) |
| ***F25D 17/04*** | (2006.01) |
| ***F25D 29/00*** | (2006.01) |

(52) U.S. Cl.

CPC ..... *F25D 23/028* (2013.01); *F25D 17/047* (2013.01); *F25D 29/005* (2013.01); *F25D 2700/02* (2013.01)

(58) Field of Classification Search

CPC .... F25D 23/028; F25D 17/047; F25D 29/005; F25D 2700/02

See application file for complete search history.

(56) References Cited

U.S. PATENT DOCUMENTS 4,707,684 A * 11/1987 Janke ..... F25D 29/008 200/61.62
6,338,536 B1 * 1/2002 Ueno ..... E05B 17/0033 312/405
6,811,236 B1 * 11/2004 Spong ..... E05C 19/166 312/222

(Continued)

FOREIGN PATENT DOCUMENTS

| | | | |
|---|---|---|---|
| DE | 102006061083 | A1 | 6/2008 |
| JP | 2006284147 | A | 10/2006 |
| WO | 2014198634 | A1 | 12/2014 |

*Primary Examiner* — Hanh V Tran

(74) *Attorney, Agent, or Firm* — Laurence A. Greenberg; Werner H. Stemer; Ralph E. Locher

(57) ABSTRACT

A household appliance includes an interior compartment, a door for closing the interior compartment and a drive facility for assisting with opening the door. The household appliance further includes a pressure sensing facility for detecting or sensing a difference between an interior pressure inside the interior compartment and an ambient pressure outside the interior compartment. The drive facility is configured to apply a driving force to the door as a function of the difference between the pressures.

14 Claims, 3 Drawing Sheets

(56) References Cited

U.S. PATENT DOCUMENTS

| | | | | |
|---|---|---|---|---|
| 7,005,983 | B2 * | 2/2006 | Holmes | F25D 29/008 340/545.6 |
| 9,062,911 | B2 | 6/2015 | Keller et al. | |
| 2004/0103584 | A1 * | 6/2004 | Freeman | E05F 15/77 49/334 |
| 2005/0269334 | A1 | 12/2005 | Bang et al. | |
| 2006/0107597 | A1 * | 5/2006 | Jin | E05F 15/63 49/149 |
| 2006/0242908 | A1 * | 11/2006 | McKinney | E05F 15/77 49/280 |
| 2008/0231158 | A1 * | 9/2008 | Keller | F25D 17/047 312/405 |
| 2010/0307189 | A1 * | 12/2010 | Keller | F25D 17/047 62/449 |
| 2011/0016907 | A1 * | 1/2011 | Kang | F25D 23/028 62/449 |
| 2011/0036383 | A1 * | 2/2011 | Tiekoetter | A47L 15/4259 134/57 DL |
| 2013/0276474 | A1 * | 10/2013 | Kim | F25D 11/00 62/449 |
| 2016/0116206 | A1 | 4/2016 | Kempfle et al. | |
| 2016/0281408 | A1 * | 9/2016 | Kempfle | F25D 23/028 |

* cited by examiner

HOUSEHOLD APPLIANCE COMPRISING A DOOR OPENING AID

BACKGROUND OF THE INVENTION

Field of the Invention

The invention relates to a household appliance with a door opening aid.

A door opening aid for assisting the opening of a door of a household appliance can be activated by means of an activation element, for example by means of a button, on a front face of the household appliance. In the case of a household appliance configured as a built-in appliance, a front panel is frequently attached to the front face of the household appliance when it is built into a recess in a wall of furniture, said front panel being matched visually to the wall of furniture. To allow activation of the door opening aid by means of the activation element on the front face of the household appliance, an opening can therefore be created in the front panel before said front panel is attached to the front ii face of the household appliance but this perforation of the front plate is a complex procedure.

The publication DE 10 2006 061083 A1 describes a refrigeration appliance with a drive element which is arranged in such a manner as to drive a door of the refrigeration appliance from a closed position. The drive element is coupled to a control circuit which is suitable for activating the drive element when a door movement is detected. In one preferred embodiment the refrigeration appliance comprises a pressure sensor for detecting the pressure in an interior compartment of the refrigeration appliance. The control circuit is suitable for activating the drive element as a function of the pressure prevailing in the interior compartment.

The pressure in the interior compartment of a refrigeration appliance can however be subject to pressure fluctuations, which can be caused for example by the cooling of the air in the interior compartment of the refrigeration appliance. It is therefore complex to detect door movement by detecting a pressure change in the interior compartment of the refrigeration appliance.

BRIEF SUMMARY OF THE INVENTION

It is the object of the invention to specify a household appliance with a door opening aid, wherein the door opening aid can be activated precisely and efficiently.

This object is achieved by subject matter with the features set out in the independent claim. Advantageous embodiments of the invention are set out in the figures, the description and the dependent claims.

According to one aspect of the invention the object is achieved by a household appliance with an inner container, a door for closing the inner container and a drive facility for assisting the opening of the door, wherein the household appliance has a pressure sensing facility for detecting a pressure difference between an interior pressure in the interior of the inner container and an ambient pressure outside the inner container and wherein the drive facility is configured to apply a drive force to the door as a function of the pressure difference. This has the technical advantage for example that the door can be driven precisely to assist the opening of said door.

A household appliance is an appliance used for household management. It can be a large household appliance, for example a washing machine, a tumble dryer, a dishwasher, a cooking appliance, an extractor hood or a refrigeration appliance such as a refrigerator, freezer or combined refrigerator/freezer. It can however also be a small household appliance, for example a water heater, an automatic coffee maker, a food processor or a vacuum cleaner.

A refrigeration appliance is in particular a household refrigeration appliance, in other words a refrigeration appliance used for household management in a domestic context or in catering, serving in particular to store food and/or beverages at defined temperatures, for example a refrigerator, an upright freezer, a combined refrigerator/freezer, a chest freezer or a wine chiller cabinet.

The household appliance can also be a built-in appliance or a free-standing appliance.

The drive facility and the pressure sensing facility can be elements of a door opening aid or can form a door opening aid. The application of the drive force to the door can assist the opening of the door. The pressure difference can be the difference between the ambient pressure and the interior pressure. The pressure difference can also be determined by subtracting the interior pressure from the ambient pressure.

A tensile force applied to the door can cause the interior pressure to be reduced while the ambient pressure can remain constant. For example a user of the household appliance applies a tensile force to the door to activate the door opening aid. If the pressure difference reaches a predetermined threshold value within a predetermined time period, the drive facility can apply the drive force to the door. The predetermined threshold value is 0.001 mbar, 0.01 mbar, 0.05 mbar, 0.1 mbar, 0.3 mbar, 0.5 mbar, 0.7 mbar, 1 mbar, 5 mbar, 10 mbar, 25 mbar or 50 mbar for example. The predetermined time period is 0.05 s, 0.1 s, 0.15 s, 0.2 s, 0.25 s, 0.3 s, 0.35 s, 0.4 s, 0.45 s or 0.5 s for example. The drive facility can also be configured to apply the drive force to the door with a delay. For example the drive facility can apply the drive force to the door 0.05 s, 0.1 s, 0.15 s, 0.2 s, 0.25 s or 0.3 s after the predetermined threshold value has been reached.

A compression force applied to the door can also cause an increase in the interior pressure followed by a reduction of the interior pressure, while the ambient pressure can remain constant. For example a user of the household appliance applies a compression force to the door in order to activate the door opening aid. If the pressure difference reaches a first predetermined threshold value within a first predetermined time period and then a second predetermined threshold value within a second predetermined time period, the drive facility can apply the drive force to the door. The first predetermined threshold value is −0.001 mbar, −0.01 mbar, −0.05 mbar, −0.1 mbar, −0.3 mbar, −0.5 mbar, −0.7 mbar, −1 mbar, −5 mbar, −10 mbar, −25 mbar or −50 mbar for example. The first predetermined time period is 0.05 s, 0.1 s, 0.15 s, 0.2 s, 0.25 s, 0.3 s, 0.35 s, 0.4 s, 0.45 s or 0.5 s for example. The second predetermined threshold value is 0.001 mbar, 0.01 mbar, 0.05 mbar, 0.1 mbar, 0.3 mbar, 0.5 mbar, 0.7 mbar, 1 mbar, 5 mbar, 10 mbar, 25 mbar or 50 mbar for example. The second predetermined time period is 0.05 s, 0.1 s, 0.15 s, 0.2 s, 0.25 s, 0.3 s, 0.35 s, 0.4 s, 0.45 s or 0.5 s for example. The drive facility can also be configured to apply the drive force to the door with a delay. For example the drive facility can apply the drive force to the door 0.05 s, 0.1 s, 0.15 s, 0.2 s, 0.25 s or 0.3 s after the second predetermined threshold value has been reached. The pressure sensing facility can comprise a pressure sensor for detecting the pressure difference, the interior pressure and/or the ambient pressure. The drive facility can also apply the drive force to the door by means of a drive unit.

In one advantageous embodiment the pressure sensing facility comprises a differential pressure sensor for detecting the pressure difference between the interior pressure and the ambient pressure. This has the technical advantage for example that the pressure difference can be detected precisely.

The differential pressure sensor can comprise a first chamber in which the interior pressure prevails and a second chamber in which the ambient pressure prevails, these being separated by a membrane. A deflection of the membrane can be a measure of the pressure difference. For example the membrane comprises a strain gauge strip, the electrical resistance of which can change when the membrane is deflected. It is possible to determine the pressure difference by detecting the electrical resistance of the strain gauge strip. The differential pressure sensor can further comprise a pressure sensor for detecting the interior pressure or a pressure sensor for detecting the ambient pressure.

In a further advantageous embodiment the pressure sensing facility comprises a first pressure sensor for detecting the interior pressure and a second pressure sensor for detecting the ambient pressure. This has the technical advantage for example that the interior pressure and the ambient pressure can be supplied independently of one another.

The respective pressure sensor can be a capacitive pressure sensor. For example the capacitive pressure sensor comprises a first electrode and a second electrode configured as a membrane, the first electrode and the second electrode being separated by an electrically insulating layer and forming a capacitor. A deflection of the second electrode configured as a membrane, for example as a result of a pressure change, can cause the capacitance of the capacitor to change. The pressure on the membrane can be determined by detecting the capacitance of the capacitor.

In a further advantageous embodiment the pressure sensing facility is also configured to determine the pressure difference between the detected interior pressure and the detected ambient pressure. This has the technical advantage for example that the pressure difference can be supplied.

The pressure sensing facility can comprise a processor for determining the pressure difference. For example the processor forms the difference between the detected interior pressure and the detected ambient pressure to determine the pressure difference.

In a further advantageous embodiment the pressure sensing facility is connected to the inner container by way of an interior pressure line to detect the interior pressure. This has the technical advantage for example that the pressure sensing facility can be arranged outside the inner container.

The interior pressure line can be a hose or a pipe.

In a further advantageous embodiment the interior pressure line comprises a membrane or a membrane covering. This has the technical advantage for example that the pressure sensing facility can be shielded from dust or moisture from the inner container.

In a further advantageous embodiment the pressure sensing facility is connected to the surroundings of the inner container by way of an ambient pressure line to detect the ambient pressure. This has the technical advantage for example that the pressure sensing facility can be arranged at any point within a housing of the household appliance.

The ambient pressure line can be a hose or a pipe.

In a further advantageous embodiment the ambient pressure line comprises a membrane or a membrane covering. This has the technical advantage for example that the pressure sensing facility can be shielded from dust or moisture from the surroundings of the inner container.

In a further advantageous embodiment the household appliance further comprises a drainage line connecting the inner container to the surroundings of the inner container. This has the technical advantage for example that pressure equalization can take place between the interior pressure in the interior of the inner container and the ambient pressure outside the inner container.

In a further advantageous embodiment the drive facility is arranged on a cross member of the household appliance. This has the technical advantage for example that the counter force to the drive force acting on the drive facility can be compensated for by the housing of the household appliance.

The cross member can be a bottom cross member. The cross member can also be arranged in a thermally insulating wall of the household appliance. The thermally insulating wall can comprise foam or foamed material.

In a further advantageous embodiment the drive facility is further configured to determine the extent of the drive force as a function of the pressure difference. This has the technical advantage for example that the speed of door opening can be varied as a function of the pressure difference.

For example the drive force on the door in the event of a tensile force applied to the door is greater than when a compression force is applied to the door.

In a further advantageous embodiment the drive facility comprises a drive unit for applying the drive force to the door. This has the technical advantage for example that the drive force can be applied to the door efficiently.

The drive unit can apply an impact force or a pushing force to the door.

In a further advantageous embodiment the drive facility further comprises an electric motor for driving the drive unit. This has the technical advantage for example that the drive unit can be driven efficiently.

In a further advantageous embodiment the drive facility further comprises a linear motor for driving the drive unit. This has the technical advantage for example that the drive unit can be moved in a straight line to apply the drive force to the door.

In a further advantageous embodiment the drive facility further comprises an elastic spring element for driving the drive unit. This has the technical advantage for example that the drive unit can be driven by means of a mechanical force.

The elastic spring element can be a mechanical spring.

BRIEF DESCRIPTION OF THE SEVERAL VIEWS OF THE DRAWING

Exemplary embodiments of the invention are illustrated in the drawings and described in more detail below.

In the drawings.

DESCRIPTION OF THE INVENTION

Figure 1:
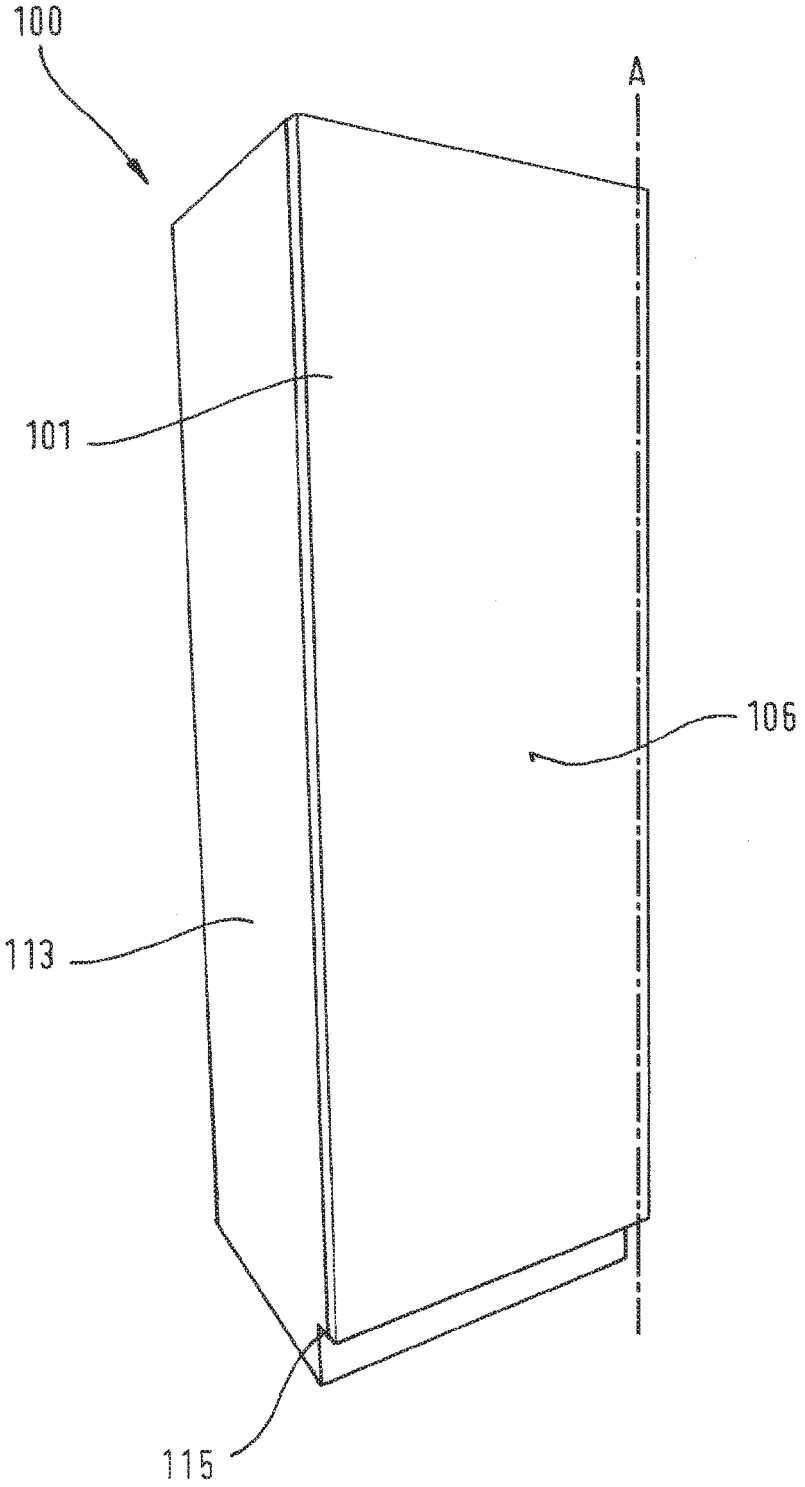
FIG. 1 shows a perspective view of a household appliance according to one exemplary embodiment.

FIG. 1 shows a perspective view of a household appliance 100 according to one exemplary embodiment. The household appliance 100 can be a refrigeration appliance. The household appliance 100 comprises a housing 113 and a door 101. The household appliance 100 further comprises a cross member 115. The cross member 115 is arranged on a lower face of the refrigeration appliance 100. An activation surface 106 is also shown.

A household appliance 100 is an appliance used for household management. It can be a large household appliance, for example a washing machine, a tumble dryer, a dishwasher, a cooking appliance, an extractor hood or a refrigeration appliance such as a refrigerator, freezer or combined refrigerator/freezer. It can however also be a small household appliance, for example a water heater, an automatic coffee maker, a food processor or a vacuum cleaner.

A refrigeration appliance is in particular a household refrigeration appliance, in other words a refrigeration appliance used for household management in a domestic context or in catering, serving in particular to store food and/or beverages at defined temperatures, for example a refrigerator, an upright freezer, a combined refrigerator/freezer, a chest freezer or a wine chiller cabinet.

The household appliance 100 further comprises an inner container 105 (not shown here). The door 101 is connected pivotably to the housing 113. The door 101 can be pivoted about a pivot axis A.

The pressure sensing facility can be configured to detect a compression force acting on the activation surface 106.

Figure 2:
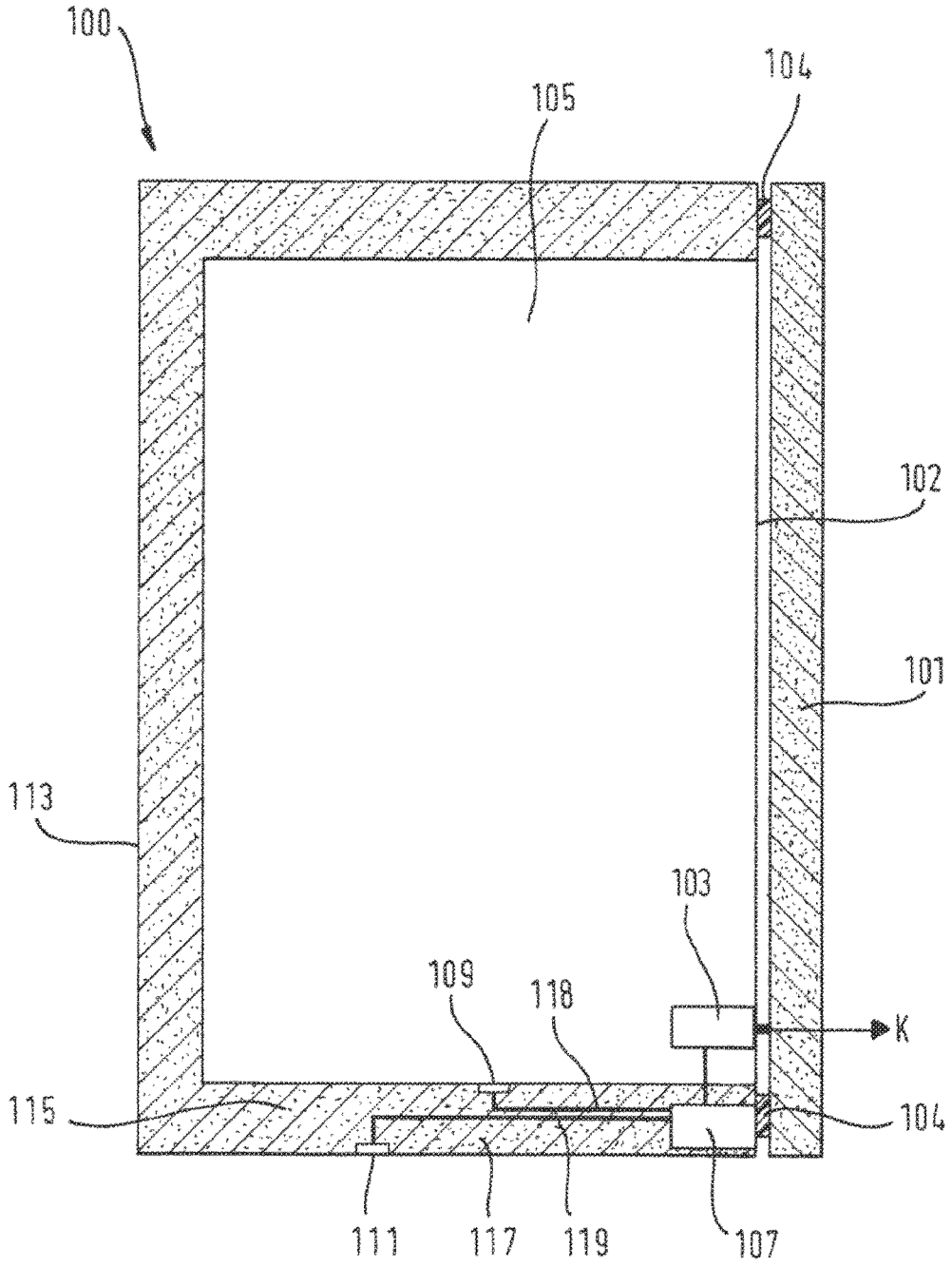
FIG. 2 shows a sectional view of the household appliance according to the exemplary embodiment.

FIG. 2 shows a sectional view of the household appliance 100 according to the exemplary embodiment. The household appliance 100 further comprises a seal 104, which is arranged around the edge of an opening 102 and serves to seal it in relation to the door 101. The household appliance 100 further comprises a drive facility 103 for driving the door 101. The household appliance 100 further comprises a pressure sensing facility 107 for determining a pressure difference Δp between an interior pressure $p_I$ prevailing in the inner container 105 and an ambient pressure $p_A$ prevailing in the surroundings 108 around the household appliance 100.

The household appliance 100 comprises an inner container 105, a door 101 for closing the inner container 105 and a drive facility 103 for assisting the opening of the door 101. The household appliance 100 further comprises a pressure sensing facility 107 for detecting a pressure difference Δp between an interior pressure $p_I$ in the interior of the inner container 105 and an ambient pressure $p_A$ outside the inner container 105. The drive facility 103 is also configured to apply a drive force K to the door 101 as a function of the pressure difference Δp. The household appliance 100 can also be a built-in appliance or a free-standing appliance.

The drive facility 103 and the pressure sensing facility 107 can be elements of a door opening aid or can form a door opening aid. The application of the drive force K to the door 101 can assist the opening of the door 101.

The pressure difference Δp can be the difference between the ambient pressure $p_A$ and the interior pressure $p_I$. The pressure difference Δp is defined for example by:

$$\Delta p = p_A - p_I.$$

A tensile force applied to the door can cause the interior pressure $p_I$ to be reduced while the ambient pressure $p_A$ can remain constant. For example a user of the household appliance 100 applies a tensile force to the door 101 to activate the door opening aid. If the pressure difference Δp reaches a predetermined threshold value within a predetermined time period, the drive facility 103 can apply the drive force K to the door 101. The predetermined threshold value is 0.001 mbar, 0.01 mbar, 0.05 mbar, 0.1 mbar, 0.3 mbar, 0.5 mbar, 0.7 mbar, 1 mbar, 5 mbar, 10 mbar, 25 mbar or 50 mbar for example. The predetermined time period is 0.05 s, 0.1 s, 0.15 s, 0.2 s, 0.25 s, 0.3 s, 0.35 s, 0.4 s, 0.45 s or 0.5 s for example. The drive facility 103 can also be configured to apply the drive force K to the door 101 with a delay. For example the drive facility 103 can apply the drive force K to the door 101 0.05 s, 0.1 s, 0.15 s, 0.2 s, 0.25 s or 0.3 s after the predetermined threshold value has been reached.

A compression force applied to the door 101 can also cause an increase in the interior pressure $p_I$ followed by a reduction of the interior pressure $p_I$, while the ambient pressure $p_A$ can remain constant. For example a user of the household appliance 100 applies a compression force to the door 101 in order to activate the door opening aid. If the pressure difference Δp reaches a first predetermined threshold value within a first predetermined time period and then a second predetermined threshold value within a second predetermined time period, the drive facility 103 can apply the drive force K to the door 101. The first predetermined threshold value is −0.001 mbar, −0.01 mbar, −0.05 mbar, −0.1 mbar, −0.3 mbar, −0.5 mbar, −0.7 mbar, −1 mbar, −5 mbar, −10 mbar, −25 mbar or −50 mbar for example. The first predetermined time period is 0.05 s, 0.1 s, 0.15 s, 0.2 s, 0.25 s, 0.3 s, 0.35 s, 0.4 s, 0.45 s or 0.5 s for example. The second predetermined threshold value is 0.001 mbar, 0.01 mbar, 0.05 mbar, 0.1 mbar, 0.3 mbar, 0.5 mbar, 0.7 mbar, 1 mbar, 5 mbar, 10 mbar, 25 mbar or 50 mbar for example. The second predetermined time period is 0.05 s, 0.1 s, 0.15 s, 0.2 s, 0.25 s, 0.3 s, 0.35 s, 0.4 s, 0.45 s or 0.5 s for example. The drive facility 103 can also be configured to apply the drive force K to the door 101 with a delay. For example the drive facility 103 can apply the drive force K to the door 101 0.05 s, 0.1 s, 0.15 s, 0.2 s, 0.25 s or 0.3 s after the second predetermined threshold value has been reached.

The pressure sensing facility 107 can comprise a pressure sensor for detecting the pressure difference Δp, the interior pressure $p_I$ and/or the ambient pressure $p_A$. The drive facility 103 can also apply the drive force K to the door 101 by means of a drive unit.

The drive facility 103 is suitable for applying a drive force K to the door 101 as a function of the pressure difference Δp. The drive facility 103 can be arranged adjacent to the door 101. The drive facility 103 is preferably arranged in the inner container 105 adjacent to the opening 102. Alternatively the drive facility 103 can be arranged outside the inner container 105.

The pressure sensing facility 107 is arranged on the cross member 115. The pressure sensing facility 107 is preferably arranged in a thermally insulating wall 117 arranged on the cross member 115.

The pressure sensing facility 107 is connected to the inner container 105 by means of an interior pressure line 118 which is covered by a membrane covering 109. To this end a side wall of the inner container 105 can comprise an opening which is connected to the interior pressure line 118 and covered by the membrane covering 109. The pressure sensing facility 107 is also connected to the surroundings of the inner container 105 by means of an ambient pressure line 119 which is covered by a membrane covering 111. To this end a side wall of the housing 113 can comprise an opening which is connected to the ambient pressure line 119 and covered by the membrane covering 111.

The pressure sensing facility 107 can comprise a differential pressure sensor for detecting the pressure difference Δp between the interior pressure $p_I$ and the ambient pressure $p_A$.

The differential pressure sensor can comprise a first chamber in which the interior pressure $p_I$ prevails and a second chamber in which the ambient pressure $p_A$ prevails, these being separated by a membrane. A deflection of the membrane can be a measure of the pressure difference Δp. For example the membrane comprises a strain gauge strip, the electrical resistance of which can change when the membrane is deflected. It is possible to determine the pressure difference Δp by detecting the electrical resistance of the strain gauge strip.

The pressure sensing facility 107 can further comprise a first pressure sensor for detecting the interior pressure $p_I$ and a second pressure sensor for detecting the ambient pressure $p_A$.

The respective pressure sensor can be a capacitive pressure sensor. For example the capacitive pressure sensor comprises a first electrode and a second electrode configured as a membrane, the first electrode and the second electrode being separated by an electrically insulating layer and forming a capacitor. A deflection of the second electrode configured as a membrane, for example as a result of a pressure change, can cause the capacitance of the capacitor to change. The pressure on the membrane can be determined by detecting the capacitance of the capacitor.

The pressure sensing facility 107 can also configured to determine the pressure difference Δp between the detected interior pressure $p_I$ and the detected ambient pressure $p_A$. To this end the pressure sensing facility 107 can comprise a processor for determining the pressure difference Δp. For example the processor forms the difference between the detected interior pressure $p_I$ and the detected ambient pressure $_{PA}$ to determine the pressure difference Δp.

Figure 3:
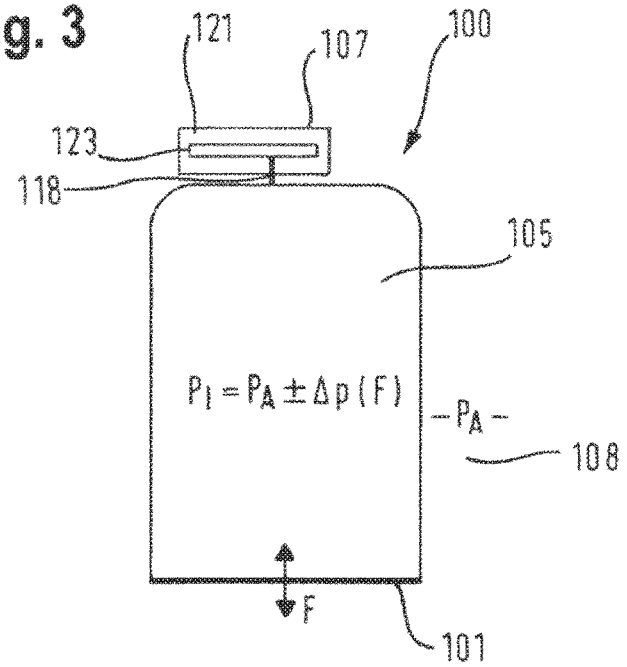
FIG. 3 shows a schematic view of the household appliance according to the exemplary embodiment.

FIG. 3 shows a schematic view of the household appliance 100 according to the exemplary embodiment. The door 101, the inner container 105, the pressure sensing facility 107 and the surroundings 108 of the household appliance are shown schematically here. An interior compartment 121 of the pressure sensing facility 107, a pressure sensor arrangement 123 and the interior pressure line 118 are also shown. When a person applies a force F to the door 101, a pressure difference Δp results between the inner container 105 and the surroundings 108.

The pressure sensor arrangement 123 can comprise a differential pressure sensor arranged on a printed circuit board (PCB) and connected to the inner container 105 by way of the interior pressure line 118. The ambient pressure $p_A$ can prevail in the interior compartment 121 of the pressure sensing facility 107. The pressure sensing facility 107 can also have an opening for pressure equalization with the surroundings 108. The differential pressure sensor can be configured to determine the pressure difference Δp between the interior pressure $p_I$ and the ambient pressure $p_A$.

The pressure sensor arrangement 123 can further comprise a first pressure sensor which is connected to the inner container 105 by way of the interior pressure line 118 to detect the interior pressure $p_I$ and a second pressure sensor to detect the ambient pressure $p_A$. The first pressure sensor and the second pressure sensor can be arranged on a printed circuit board (PCB).

The relationship between interior pressure $p_I$, ambient pressure $p_A$, pressure difference Δp and force F can be described as follows based on an equation:

$$p_I = p_A + \Delta p(F).$$

Figure 4:
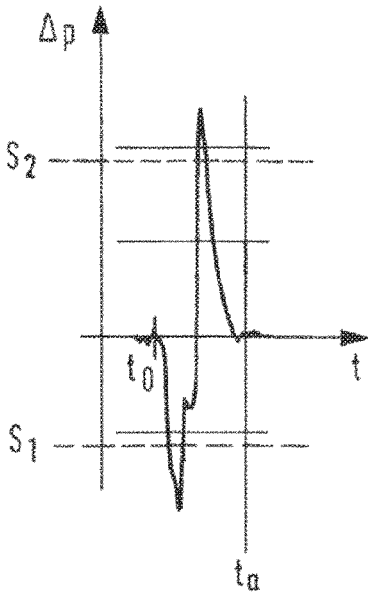
FIG. 4 shows a profile of the pressure difference that results when a compression force is applied to a door of the household appliance.
Figure 5:
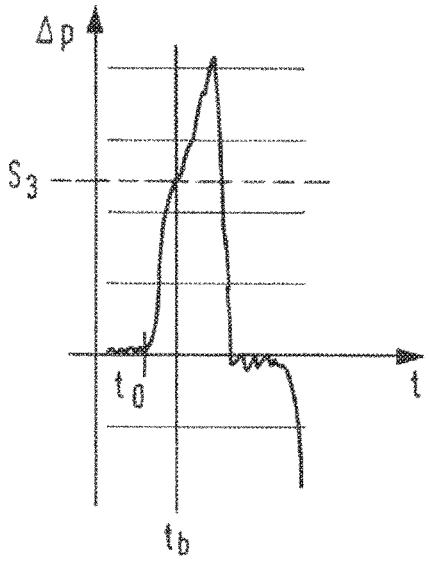
FIG. 5 shows a profile of the pressure difference that results when a tensile force is applied to the door.

FIGS. 4 and 5 show profiles of the pressure difference Δp. The pressure difference Δp here is obtained by subtracting the interior pressure $p_I$ from the ambient pressure $p_A$.

FIG. 4 shows a profile of the pressure difference Δp that results when a compression force is applied to a door 101 of the household appliance 100. To this end a person operating the household appliance 100 can apply a force F to the door 101 to cause the drive facility 103 to apply a drive force K to the door 101 so that the person is able to open the door 101 more easily, F being a compression force F. The compression force F is applied from the actuation time point $t_0$. This produces an overpressure in the inner container 105, which is expressed by a negative pressure difference Δp in the illustrated profile of the pressure difference Δp. If the person then releases the door 101 again, in other words the person no longer applies a compression force F to the door 101, the interior pressure $p_I$ drops in relation to the ambient pressure $p_A$. The compression force F applied to the door 101 by the person can then be identified when the pressure difference Δp drops below a first threshold value $S_1$ and then rises above a second threshold value $S_2$. The drive facility 103 can then apply the drive force K to the door 101 at a first trigger time point $t_a$. The first trigger time point $t_a$ is preferably between approx. 0.2 and approx. 1.0 seconds, more preferably between approx. 0.3 and approx. 0.6 seconds, more preferably approx. 0.5 seconds after the actuation time point $t_0$.

FIG. 5 shows a profile of the pressure difference Δp that results when a tensile force is applied to the door 101. To this end a person operating the household appliance 100 can apply a force F to the door 101 to cause the drive facility 103 to apply a drive force K to the door 101 so that the person is able to open the door 101 more easily, F being a tensile force F. The tensile force F is applied from the actuation time point $t_0$. This produces an underpressure in the inner container 105, which is expressed by a positive pressure difference Δp in the illustrated profile of the pressure difference Δp. The pressure difference Δp then increases over time t. The desire of the person to open the door 101 can be identified if the pressure difference Δp exceeds a further threshold $S_3$ and the drive facility 103 can apply the drive force K to the door 101 at a second trigger time point $t_b$. The second trigger time point $t_b$ is preferably between approx. 0.05 and approx. 0.5 seconds, more preferably between approx. 0.1 and approx. 0.4 seconds, more preferably approx. 0.2 seconds after the actuation time point $t_0$.

According to one embodiment the pressure sensing facility 107 can comprise an absolute pressure sensor or a differential pressure sensor. In particular the pressure sensing facility 107 can comprise a differential pressure sensor with two ports.

According to one embodiment a household appliance 100 or refrigeration appliance built into a recess can generate minor or highly dynamic pressure differences in the inner container 105 or in the interior compartment compared with ambient pressure $p_A$ when a door handle is pulled or the door 101 or a door front is pushed.

According to one embodiment the inner container 105 or the interior compartment can be designed without water drainage or with a drainage line or a water drainage line for example for connection to the surroundings and/or for pressure equalization. This can have a minor influence on the detection of the pressure difference Δp, as can other pressure fluctuations, for example pressure fluctuations due to compressor runtimes, which can be static pressure changes compared with a door release.

According to one embodiment the door opening aid is arranged in a space outside the inner container 105 or the appliance interior compartment, for example on a cross member 115 of a thermally insulating wall 117 or in a bottom cross member in a foam. The pressure sensing facility 107 or the sensor can also be linked to the inner container 105 or the interior compartment by way of the interior pressure line 118 or a hose which can comprise the membrane covering 109.

According to one embodiment the pressure sensing facility 107 is configured with high resolution.

According to one embodiment it is possible to distinguish between the door 101 being pulled and the door 101 being pushed. This allows the drive facility 103 or actuator to be activated differently, for example more slowly or quickly.

According to one embodiment the pressure sensing facility 107 can comprise a differential pressure sensor with a clearly defined operating point.

All the features described and illustrated in conjunction with individual embodiments of the invention can be provided in different combinations in the inventive subject matter in order to bring about their advantageous effects simultaneously.

The scope of protection of the present invention is defined by the claims and is not restricted by the features described in the description or illustrated in the figures.

LIST OF REFERENCE CHARACTERS

100 Household appliance
101 Door
102 Opening
103 Drive facility
104 Seal
105 Inner container
106 Activation surface
107 Pressure sensing facility
108 Surroundings
109 Membrane covering
111 Membrane covering
113 Housing
115 Cross member
117 Thermally insulating wall
118 Interior pressure line
119 Ambient pressure line
121 Interior compartment
123 Pressure sensor arrangement
$p_A$ Ambient pressure
$p_I$ Interior pressure
$\Delta p$ Pressure difference
$S_1$ First threshold value
$S_2$ Second threshold value
$S_3$ Further threshold value
t Time
$t_0$ Actuation time point
$t_a$ First trigger time point
$t_b$ Second trigger time point
F Force
K Drive force
A Pivot axis

The invention claimed is:

1. A household appliance, comprising:

an inner container;

a door for closing said inner container;

a pressure sensing facility for detecting a pressure difference between an interior pressure inside said inner container and an ambient pressure outside said inner container; and a drive facility for assisting opening of said door, said drive facility being configured to apply a drive force to said door as a function of the pressure difference, and said drive facility being configured to:

determine an extent of the drive force as a function of the pressure difference, apply the drive force to the door if the pressure difference reaches a predetermined threshold value within a predetermined time period, and apply the drive force to the door if the pressure difference reaches a first predetermined threshold value within a first predetermined time period and then a second predetermined threshold value within a second predetermined time period.

2. The household appliance according to claim 1, wherein said pressure sensing facility includes a differential pressure sensor for detecting the pressure difference between the interior pressure and the ambient pressure.

3. The household appliance according to claim 1, wherein said pressure sensing facility includes a first pressure sensor for detecting the interior pressure and a second pressure sensor for detecting the ambient pressure.

4. The household appliance according to claim 1, wherein said pressure sensing facility is also configured to determine the pressure difference between a detected interior pressure and a detected ambient pressure.

5. The household appliance according to claim 1, which further comprises an interior pressure line connected between said pressure sensing facility and said inner container for detecting the interior pressure.

6. The household appliance according to claim 5, wherein said interior pressure line includes a membrane or a membrane covering.

7. The household appliance according to claim 1, which further comprises an ambient pressure line connected between said pressure sensing facility and surroundings of said inner container for detecting the ambient pressure.

8. The household appliance according to claim 7, wherein said ambient pressure line includes a membrane or a membrane covering.

9. The household appliance according to claim 1, which further comprises a drainage line connecting said inner container to surroundings of said inner container.

10. The household appliance according to claim 1, which further comprises a cross member of the household appliance, said drive facility being disposed on said cross member.

11. The household appliance according to claim 1, wherein said drive facility includes a drive unit for applying the drive force to said door.

12. The household appliance according to claim 11, wherein said drive facility includes an electric motor for driving said drive unit.

13. The household appliance according to claim 11, wherein said drive facility includes a linear motor for driving said drive unit.

14. The household appliance according to claim 11, wherein said drive facility includes an elastic spring element for driving said drive unit.

* * * * *